US012534255B2

(12) United States Patent
Botzenhardt et al.

(10) Patent No.: US 12,534,255 B2
(45) Date of Patent: Jan. 27, 2026

(54) PACKAGING MACHINE OR PACKAGING LINE WITH DYNAMIC RECIPE CHANGE

(71) Applicant: MULTIVAC SEPP HAGGENMUELLER SE & CO. KG, Wolfertschwenden (DE)

(72) Inventors: Claus Botzenhardt, Kempten (DE); Wolfgang Buchenberg, Wiggensbach (DE); Martin Jochem, Immenstadt im Allgaeu (DE); Stefan Merk, Wolfertschwenden (DE); Marcus Pfister, Bad Groenenbach (DE); Thomas Simon, Kammeltal (DE); Johann Woelfle, Oberguenzburg (DE); Peter Lenz, Durach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 82 days.

(21) Appl. No.: 18/104,320

(22) Filed: Feb. 1, 2023

(65) Prior Publication Data

US 2023/0242297 A1 Aug. 3, 2023

(30) Foreign Application Priority Data

Feb. 1, 2022 (DE) ..... 102022102342.7

(51) Int. Cl.

| | |
|---|---|
| ***B65B 59/00*** | (2006.01) |
| ***B65B 43/42*** | (2006.01) |
| ***B65B 65/00*** | (2006.01) |

(52) U.S. Cl.
CPC ..... *B65B 59/001* (2019.05); *B65B 43/42* (2013.01); *B65B 65/003* (2013.01)

(58) Field of Classification Search
CPC ..... B65B 43/42; B65B 57/00; B65B 59/001; B65B 59/003; B65B 59/02; B65B 65/003; B65B 9/04; G05B 19/4187; Y02P 90/02
See application file for complete search history.

(56) References Cited

U.S. PATENT DOCUMENTS 11,008,122 B2 * 5/2021 Merk ..... B65B 57/04
2015/0019005 A1 1/2015 Moreirade Costa et al.
(Continued)

FOREIGN PATENT DOCUMENTS

DE 102012221458 B3 * 12/2013 ..... B65B 57/02
DE 202016000302 U1 * 4/2016 ..... B65B 47/00
(Continued)

OTHER PUBLICATIONS

DE 102012221458 B3 Machine Translation (Year: 2013).*
(Continued)

*Primary Examiner* — Himchan Song
(74) *Attorney, Agent, or Firm* — BROOKS KUSHMAN P.C.

(57) ABSTRACT

The disclosure relates to a device for a packaging process, wherein the device is provided in the form of a step-by-step packaging machine, or is configured as a step-by-step packaging line. The device is configured to perform a recipe change from a first packaging recipe to another, second packaging recipe step by step at a plurality of work stations provided on the device. Furthermore, the disclosure relates to a corresponding method.

13 Claims, 6 Drawing Sheets

(56) References Cited

U.S. PATENT DOCUMENTS

| | | | | |
|---|---|---|---|---|
| 2020/0272224 | A1* | 8/2020 | Scarabelli | G06T 19/006 |
| 2022/0355963 | A1* | 11/2022 | Chakravarthy | B65B 59/001 |

FOREIGN PATENT DOCUMENTS

| | | | |
|---|---|---|---|
| DE | 10 2017 125 077 | A1 | 5/2019 |
| DE | 10 2018 205 005 | A1 | 10/2019 |
| EP | 1 225 491 | A1 | 7/2002 |
| EP | 3 133 022 | B1 | 7/2018 |

OTHER PUBLICATIONS

DE202016000302U1 Machine Translation (Year: 2016).*
European Search Report (with English Machine Translation) Dated Jul. 28, 2023, Application No. 22211901.8-1014, Applicant Multivac Sepp Haggenmüller SE & Co. KG, 14 Pages.
German Search Report dated Sep. 29, 2022, Application No. 10 2022 102 342.7, Applicant Multivac Sepp Haggenmueller SE & Co. KG, 6 Pages.

* cited by examiner

PACKAGING MACHINE OR PACKAGING LINE WITH DYNAMIC RECIPE CHANGE

CROSS-REFERENCE TO RELATED APPLICATIONS

This application claims foreign priority benefits under 35 U.S.C. § 119 (a)-(d) to German patent application number DE 10 2022 102 342.7, filed Feb. 1, 2022, which is incorporated by reference in its entirety.

TECHNICAL FIELD

The present disclosure relates to a device for a packaging process. Furthermore, the disclosure relates to a method for carrying out a recipe change on an intermittently operating packaging machine or on an intermittently operating packaging line.

BACKGROUND

On a packaging machine and in particular on a packaging line composed of several (packaging) machines, operators are confronted with a variety of tasks, for example with numerous process parameter readjustments and/or retooling measures required for this purpose, when changing articles, i.e., when changing a recipe, which may involve a change of format and/or a change of product, for example.

Conventionally, on the packaging line or on the packaging machine, the type of packaging currently being produced on it is completely emptied for a recipe change and then all the necessary retooling measures are carried out by the operating personnel at once in order to produce the new packaging recipe, for example a different type of packaging, after the complete retooling has been carried out. However, this approach, in which the packaging machine or line is first completely emptied and then completely modified or reset by a single retooling process, which tends to be extensive, takes up a lot of raw material (film, labels, etc.) and time. In addition, experience shows that this results in long downtimes of the packaging line or packaging machine, which increases the packaging production costs.

EP 3 133 022 B1 discloses a process wherein the packaging line or packaging machine is completely emptied in order to carry out a recipe change. This is usually accompanied by a complex retooling process that is both labor-intensive and time-consuming and depends in particular on the expertise of the operator, as all the stations of the packaging line or packaging machine have to be set and/or modified for the new recipe at once. This is a great challenge for the operating staff.

SUMMARY

It is an object of the disclosure to make a recipe change easier for the operating personnel on a packaging machine or on a packaging line, which also results in an increased potential for increasing the economic efficiency of the packaging machine or the packaging line.

Advantageous further embodiments of the disclosure are given by the respective objects of the subclaims.

The disclosure relates to a device for a packaging process, wherein the device is provided in the form of a step-by-step packaging machine, or is configured as a step-by-step packaging line, each comprising at least a first workstation, at least one second work station mounted at a distance from the first work station in the production direction and at least one control device functionally connected to the first and second work stations, which is configured, on the basis of a first control step, in response to a recipe change activated on the packaging machine or on the packaging line from one first packaging recipe to another, second packaging recipe for producing a work cycle formed first in the production direction within the first work station in accordance with the second packaging recipe to set automatically at least one process parameter required for this at the first workstation and/or to notify an operator of at least one retooling measure of the first work station, wherein the control device is further configured, in response to the activated recipe change by means of a second control step for producing the work cycle formed first in the production direction within the second work station in accordance with the second packaging recipe, to automatically set at least one process parameter required for this at the second work station and/or to notify the operator of at least one retooling measure of the second work station.

According to the disclosure, the control device is configured to perform the second control step after the first control step at the time when a work cycle directly preceding, in the production direction, the work cycle first formed according to the second packaging recipe and last formed according to the first packaging recipe within the first work station has advanced from the first work station into the second work station or has been at least partially further processed therein.

In other words, in the disclosure, despite the activated recipe change, the packaging batch produced up to that point along the packaging machine or the packaging line according to the first packaging recipe, i.e., the work cycle located within the first work station at the time of activation of the desired recipe change, as well as the work cycles preceding it in the production direction along the packaging machine or the packaging line, are still completely produced until completion. In this case, the corresponding work stations of the packaging machine or packaging line that have to be reset and/or retooled for the recipe change can be changed over to the second packaging recipe step by step one after the other, i.e., always only when the work cycle located within the preceding first work station at the time of activation of the desired recipe change arrives in them at a later time or is at least partially completed in them.

The change of the individual workstations from operation according to the first packaging recipe to operation according to the second packaging recipe thus takes place from workstation to workstation in intervals successively, wherein the time at which reset and/or retooling measures can be activated at the respective workstations positioned successively in the production direction depends on the number of work cycles in between. As a result, there is produced much less material waste or it can be reduced to a minimum because the recipe change is carried out seamlessly, so to speak.

With the disclosure, the recipe change can be integrated into the ongoing packaging process economically and to a manageable extent for the operator. In contrast to the prior art, the disclosure no longer requires the packaging machine or line to be completely emptied and a longer machine or line stop is no longer necessary to perform all reset measures at once before the packaging process for the new recipe continues. Rather, the disclosure manages with considerably shorter downtimes for retooling the packaging line or packaging machine, since the reset measures, for example various tool changes at the respective workstations and/or new parameter settings, are carried out step by step from workstation to workstation, although the packaging process continues in between. Thus, along the packaging machine or along the packaging line, the workstations configured thereon one after the other in the production direction can be optimally set up for the new recipe. In other words, the disclosure allows the conventional large reset project required of the operator for the recipe change to be divided into several individual, smaller, i.e., reset projects, that are easier to manage.

Since with the disclosure, the corresponding workstations are only retooled for the new packaging recipe and/or assigned new process parameters when a relevant scheduled work cycle is imminent for the first time, directly at the corresponding workstation, the consumption of raw material for the recipe change can be significantly reduced.

A recipe change in the sense of the disclosure means the change between different packaging recipes or recipe creations, in particular a format-specific change, for example a change from 2×2 to 3×3 packagings per machine cycle, the change to another type of packaging, for example the change to another deep-drawing tray shape, at least one process parameter-based change, preferably at least one desired setpoint process value, for example a desired vacuum value, a desired evacuation and/or gassing pressure, a desired sealing temperature, a product-based change, for example the change to another food product as packaged item, and/or at least one material-specific change, for example the change to a new film type.

It is conceivable that various recipe creations, each of which may contain a plurality of the aforementioned changes, are retrievable by the operator by means of the control device, in particular by the control device from a memory connected to it and/or a database connected to it, for example from a cloud-based database. The operator can activate the different recipe batches by means of the control device at the press of a button, which initiates the recipe change on the packaging machine or on the packaging line.

One variant provides that the control device is configured to carry out the first control step when the work cycle preceding directly in the production direction the work cycle to be produced first in accordance with the second packaging recipe and to be produced last in accordance with the first packaging recipe has advanced into the first work station or has been at least partially processed further therein. Between this and the following work cycle, the control device may define a change limit, the interval-by-interval displacement of which in the production direction of the packaging machine or the packaging line can be visualized for an operator.

Preferably the control device is provided with a display device which in particular is provided as a part of the control device, wherein by means of the display device on the basis of the first control step for the operator, at least one instruction for the retooling measure of the first work station and/or by means of which, on the basis of the second control step for the operator, at least one instruction for the retooling measure of the second work station can be visualized. This instruction may be, for example, a task list for retooling the respective workstation and/or a video to illustrate the required work steps for retooling According to one variant, the display device can visualize the change limit.

It is conceivable that the control device is configured to define, in response to the activated recipe change, a work cycle arriving at that moment within the first work station, for example a packaging format of 2×2 packagings, as the last work cycle to be produced according to the first packaging recipe and to follow its intermittent advance, in particular the change limit between this and the work cycle following the first work cycle to be produced according to the second packaging recipe, along the packaging machine or along the packaging line and/or to visualize it by means of the display device. This may be used to provide route tracking relating to the progress of the recipe change.

In particular, the recipe change for the packaging machine or for the packaging line can be activated by means of the control device by an input made thereto for the selection of a packaging recipe of a specific packaging type stored therein. One variant provides that the control device is provided with an RFID reader, by means of which various recipe creations stored on various RFID chips can be read, whereby a recipe change can be triggered.

A particular embodiment provides that the device has at least one pair of VR goggles for the operator, which are functionally connected to the control device and by means of which at least one instruction for the retooling measure of the first and/or the second work station can be visualized. Such VR goggles configured for the packaging machine or the packaging line serve as a portable aid for the operator, by which the operator can be instructed by means of a virtual retooling scenario created for the respective workstations and which can be played in response to the respective control steps. The VR goggles may be used as a virtual change assistant for various retooling and/or adjustment measures directly at the respective workstations, without the operator being dependent on the location of the control device.

Preferably, the first work station is configured as a forming station with at least one tool component for producing (deep-drawing) trays and/or the second work station is configured as a sealing station with at least one tool component for producing sealed trays. For example, the at least one tool component of the forming station may comprise a lower mold, and the at least one tool component of the sealing station may comprise a heated sealing bar, such as a movable upper sealing bar, and/or a counter-pressure support, such as a lower support bar or plate.

In particular, the first control step applies to the tool component of the forming station and the second control step applies to the tool component of the sealing station. As soon as the second control step for the recipe change takes place, the operator has already completely modified and/or reset the forming station for the recipe change on the basis of the first control step.

According to an advantageous embodiment, the packaging machine or the packaging line includes at least one transfer device which can be controlled by means of the control device for a step-by-step transport of the work cycles processed within the first work station to the second work station spaced apart from this. As long as one of the workstations is being retooled and/or reset for the recipe change, the transfer device may be deactivated, and its operation may be resumed after the retooling and/or reset of the workstation is completed.

Furthermore, the disclosure relates to a method for carrying out a recipe change on an intermittently operating packaging machine or for carrying out a recipe change on an intermittently operating packaging line, wherein a control device sets, in response to a recipe change activated on the packaging machine or on the packaging line from one first packaging recipe to another, second packaging recipe for producing a work cycle formed first in the production direction within a first work station in accordance with the second packaging recipe, on the basis of a first control step, automatically at least one process parameter required for this at the first workstation and/or notifies an operator of at least one retooling measure of the first work station, wherein the control device further sets, in response to the activated recipe change by means of a second control step for producing the work cycle formed first in second work station, spaced apart from the first work station in production direction, in accordance with the second packaging recipe, at least one process parameter required for this at the second work station and/or notifies the operator of at least one retooling measure of the second work station.

According to the disclosure the control device performs the second control step after the first control step at the time when a work cycle directly preceding, in the production direction, the work cycle first formed according to the second packaging recipe and last formed according to the first packaging recipe within the first work station has advanced from the first work station into the second work station, positioned spaced apart from the first work station in production direction, or has been at least partially further processed therein. In particular, this results in a manufacturing process that reduces material waste and leads to increased machine utilization, as well as simplified machine operation by the operating personnel.

It may be provided that the control device carries out the first control step when the work cycle preceding directly in the production direction the work cycle to be produced first in accordance with the second packaging recipe and to be produced last in accordance with the first packaging recipe has advanced into the first work station or has been at least partially processed further therein. Preferably, the first control step is carried out when the recipe change is activated and a work cycle to be produced according to the first packaging recipe, which is located in the first work station, has been completely processed, for example has been finished forming.

Preferably the control device is provided with a display device, by means of which on the basis of the first control step for the operator at least one instruction for the retooling measure of the first work station and/or by means of which, on the basis of the second control step for the operator, at least one instruction for the retooling measure of the second work station is visualized.

BRIEF DESCRIPTION OF THE DRAWINGS

The disclosure is explained in more detail by means of exemplary embodiments according to the following figures, in which.

Identical components are marked with the same reference signs throughout the figures.

DETAILED DESCRIPTION

Figure 1:
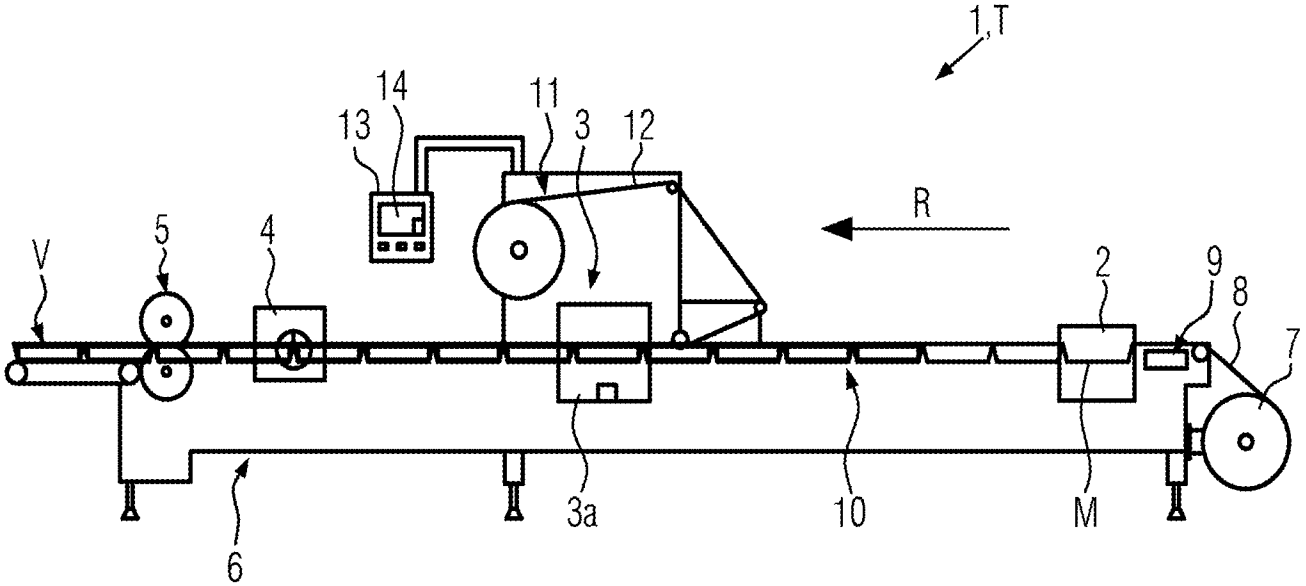
FIG. 1 is a schematic side view of a packaging machine configured as a deep-drawing packaging machine.

FIG. 1 shows a schematic side view of an intermittently operating packaging machine T, which is configured in the form of a deep-drawing packaging machine 1. This deep-drawing packaging machine 1 is provided with a forming station 2, a sealing station 3, a cross cutting device 4 and a longitudinal cutting device 5, which are arranged in this order in a production direction R on a machine frame 6. On the input side, there is a feed roller 7 on the machine frame 6, from which a bottom film 8 is drawn off. Furthermore, the deep-drawing packaging machine 1 is provided with a transport chain 9 which grips the bottom film 8 and transports it further in the production direction R per main work cycle.

In the embodiment shown, the forming station 2 is configured as a deep-drawing station in which trays are formed in the bottom film 8 by deep-drawing, for example by means of compressed air and/or vacuum. The forming station 2 may be configured in such a way that several trays M are formed next to each other in the direction perpendicular to the production direction R. Downstream of the forming station 2 in production direction R, a filling section or insertion area 10 is provided in which the trays M formed in the bottom film 8 are filled with products. Filling the trays M may be done manually by an operator.

The sealing station 3 is provided with a hermetically sealable chamber 3*a* in which the atmosphere in the trays M can be evacuated and/or replaced, for example, by gas purging with an exchange gas or with a gas mixture before sealing with the top film 12 dispensed from a top film reception 11.

The cross cutting device 4 may be configured as a punch which cuts through the bottom film 8 and the top film 12 in a direction transverse to the production direction R between adjacent trays M. The cross cutting device 4 works in such a way that the bottom film 8 is not cut across the entire width, but is not cut through at least in an edge area. This enables controlled onward transport through the transport chain 9.

The longitudinal cutting device 5 may be configured as a knife arrangement with which the bottom film 8 and the top film 12 are cut between adjacent trays M and at the lateral edge of the bottom film 8 in the production direction R, so that separated packagings V are disposed behind the cutting device 5.

The deep-drawing packaging machine 1 also includes a control device 13. This device serves for controlling and monitoring the processes taking place in the deep-drawing packaging machine 1. A display device 14 is used to visualize or influence the process sequences in the deep-drawing packaging machine 1 for or by an operator.

Figure 2:
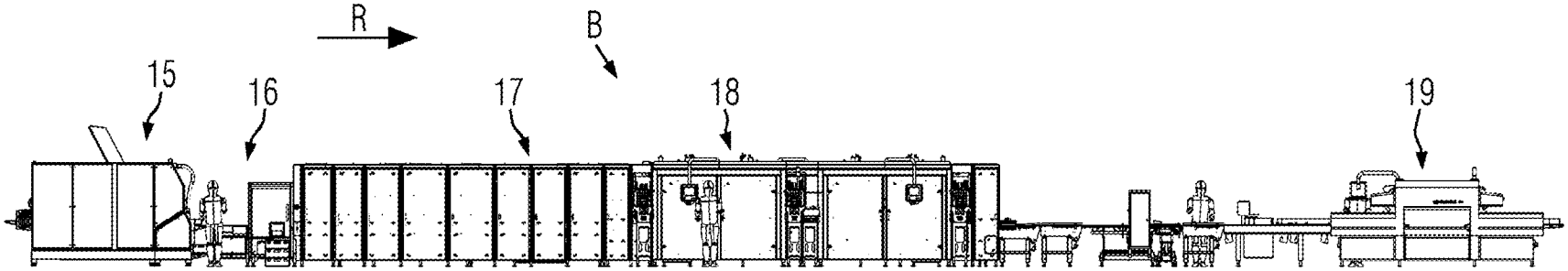
FIG. 2 is a schematic side view of a packing line.

FIG. 2 shows a packaging line B. The packaging line B comprises a slicing machine 15 for producing individual products, a weighing system 16 for weighing the individual products, a feeding device 17, two loading stations 18 and a tray sealer 19 for closing with product-laden trays arranged in this order in the production direction R. The slicing machine 15, known in the trade also as portioner, is configured to slice products at the entrance to the packaging line B, for example ribs, which are each weighed by means of the weighing system 16, arranged in a specific format along the feed device 17, loaded into trays within the loading stations 18 and transported further to the tray sealer 19 to be packed gas-tight in the trays.

Figure 3:
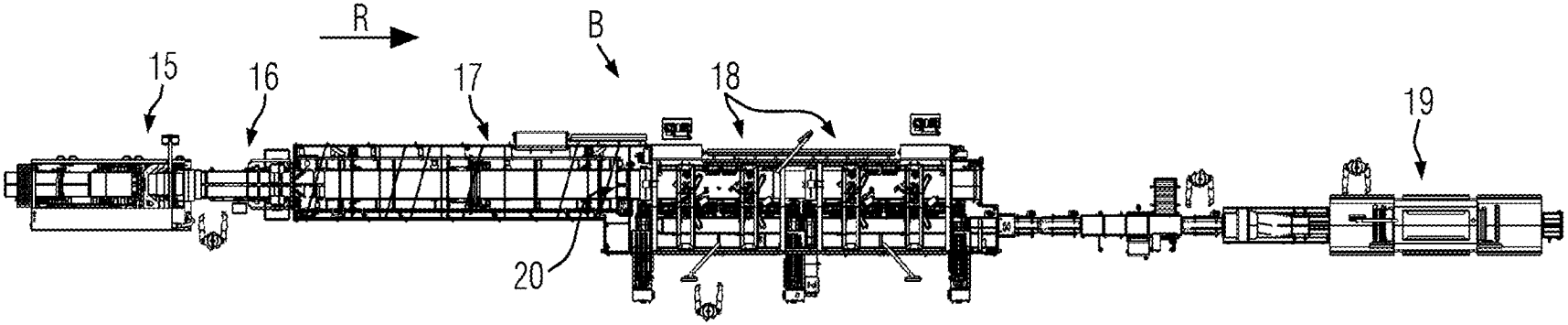
FIG. 3 is a plan view of the packaging line from FIG. 2.

FIG. 3 shows a plan view of the packaging line B from FIG. 2. The loading stations 18 arranged next to each other are used to load trays provided therein with products fed into the loading stations 18. Furthermore, the loading stations 18 are configured to transport the trays loaded with product towards the tray sealer 19. An image capturing system 20, also called a vision system, is positioned at the entrance to the loading station 18, which is arranged first in the production direction R.

FIGS. 4A to 4E show in schematic representation how the concept of a recipe change W according to the disclosure can be carried out on the deep-drawing packaging machine 1.

Figure 4A:
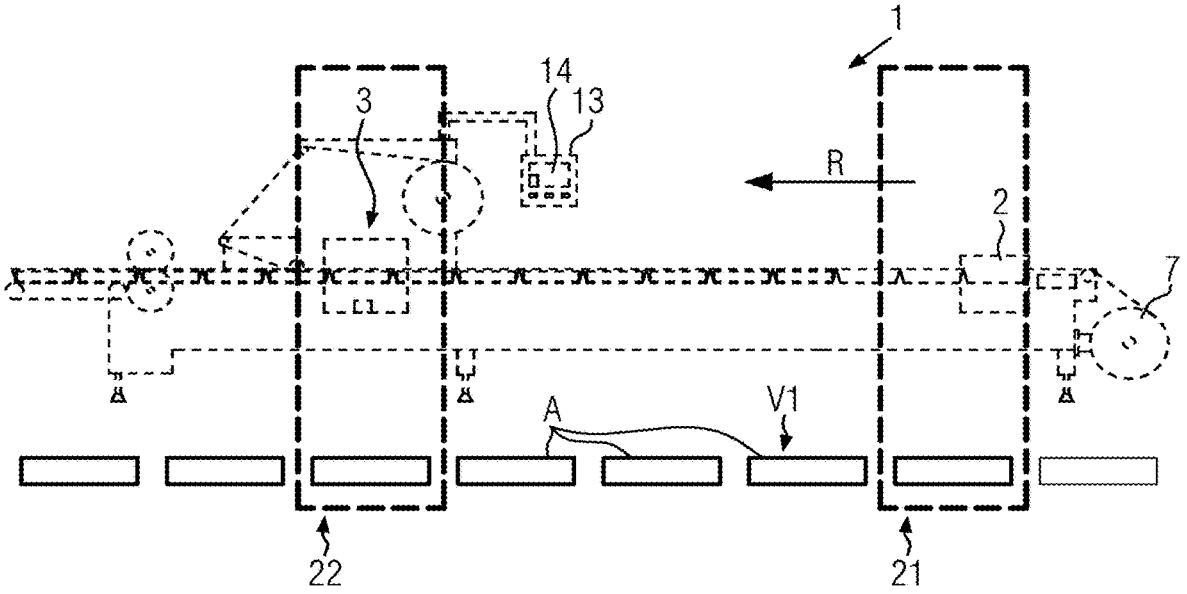
FIGS. 4A to 4H show a schematically illustrated, step-by-step recipe change on a deep-drawing packaging machine as an example.

FIG. 4A shows the deep-drawing packaging machine 1 set up to produce a first packaging recipe V1. In the deep-drawing packaging machine 1 shown in FIG. 4A, the forming station 2 positioned at the beginning is the first work station 21. The sealing station 3 of the deep-drawing packaging machine 1 is shown in FIG. 4A as a second work station 22, which is mounted at a distance from the first work station 21 in the production direction R.

FIG. 4A shows that there are a total of three work cycles A between the first work station 21 and the second work station 22. The individual work cycles A may, for example, each have a packaging format of 2×2 packagings according to the first packaging recipe V1 and are advanced step by step in production direction R according to a main machine work cycle of the deep-drawing packaging machine 1. The transport chain 9 may be used for this intermittent transport.

In FIG. 4A, the first work station 21 and the second work station 22 are equipped with corresponding tool components and/or set with corresponding process parameters for the production of the first packaging recipe V1.

Figure 4B:
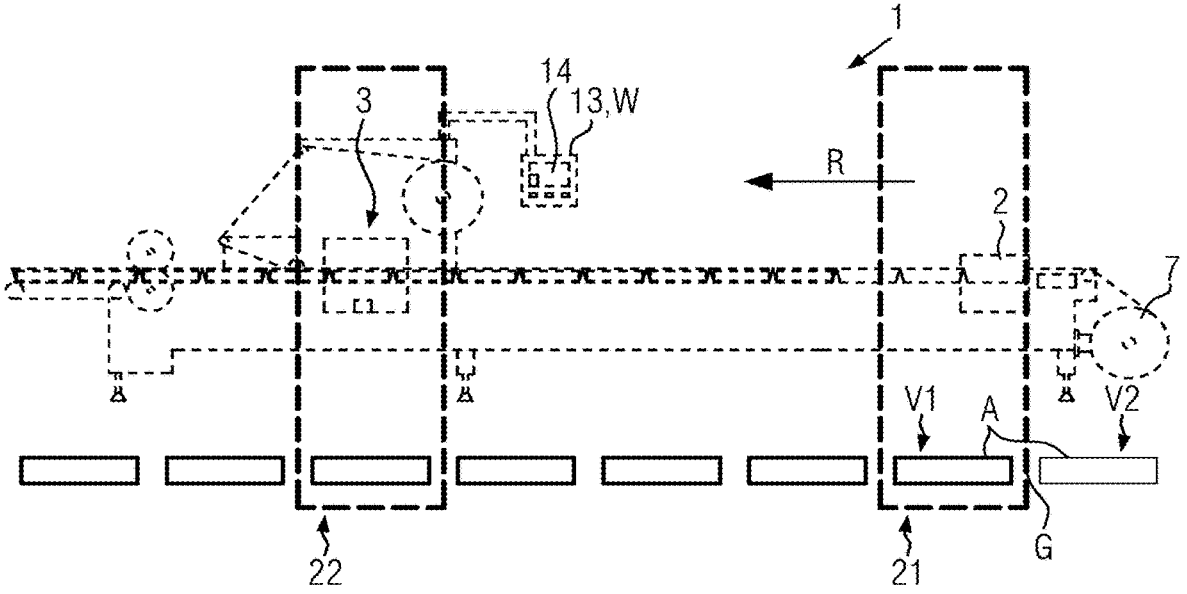

In FIG. 4B, a recipe change W is activated on the control device 13 of the deep-drawing packaging machine 1. According to the recipe change W, the deep-drawing packaging machine 1 is to be changed from the first packaging recipe V1 to another, second packaging recipe V2. FIG. 4B shows that a work cycle A positioned immediately before the first work station 21 is to be produced as the first work cycle according to the second packaging recipe V2. However, the preceding work cycle A positioned within the first work station 21 is still being produced according to the first packaging recipe V1. A change limit G is thus defined between these two work cycles A.

The recipe change W activated in FIG. 4B may be initiated by an operator on the control device 13, for example by pressing a button on a display designed for this purpose.

Figure 4C:
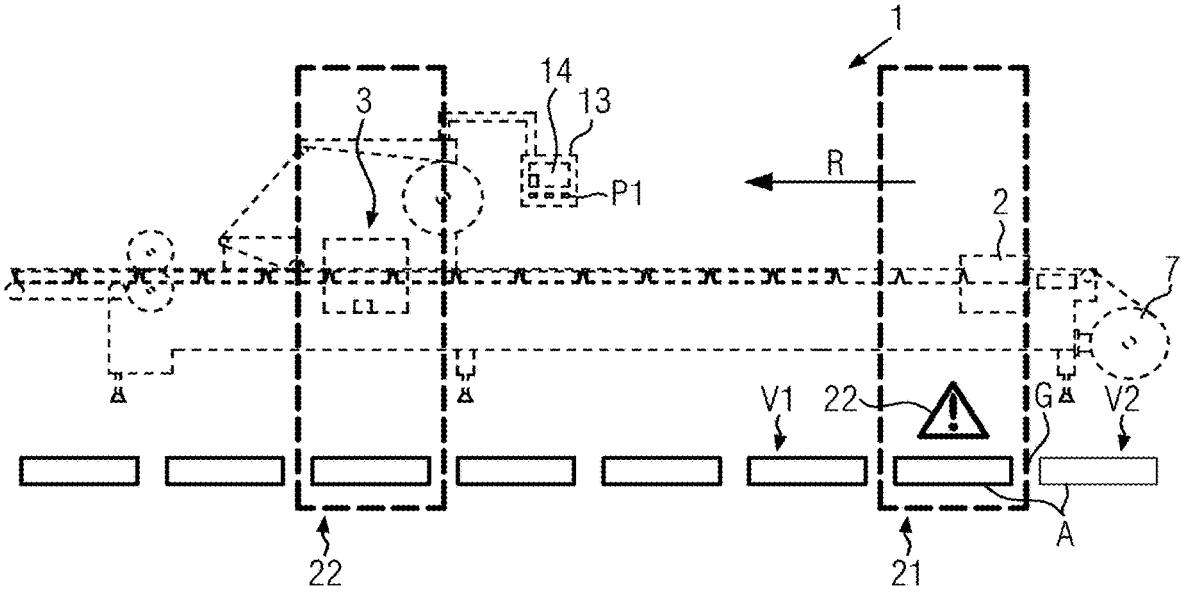

FIG. 4C shows that in response to the recipe change W activated on the deep-drawing packaging machine 1 from the first packaging format V1 to the other, second packaging format V2 for the production of the work cycle A formed first in the production direction R within the first work station 21 according to the second packaging format V2, a process parameter P required for this at the first work station 21 is automatically set and/or the operator is notified of at least one retooling measure of the first work station 21. This notification is shown in FIG. 4C as an example with an notification sign 22. A corresponding notification may be shown to the operator by means of the display device 14. Alternatively or additionally, a process parameter P1 for the operation of the first work station 21 according to the packaging recipe V2 may be changed by the control device 13.

For the production of work cycles A according to the second packaging recipe V2, the packaging process of the deep-drawing packaging machine 1 may be interrupted for a predetermined retooling or resetting interval in order to produce packages according to the second packaging recipe V2 from now on using the first work station 21. Other work stations positioned on the deep-drawing packaging machine 1 downstream in production direction R from the first work station 21, for example the sealing station 3, continue to operate for the time being according to the first packaging recipe V1.

Figure 4D:
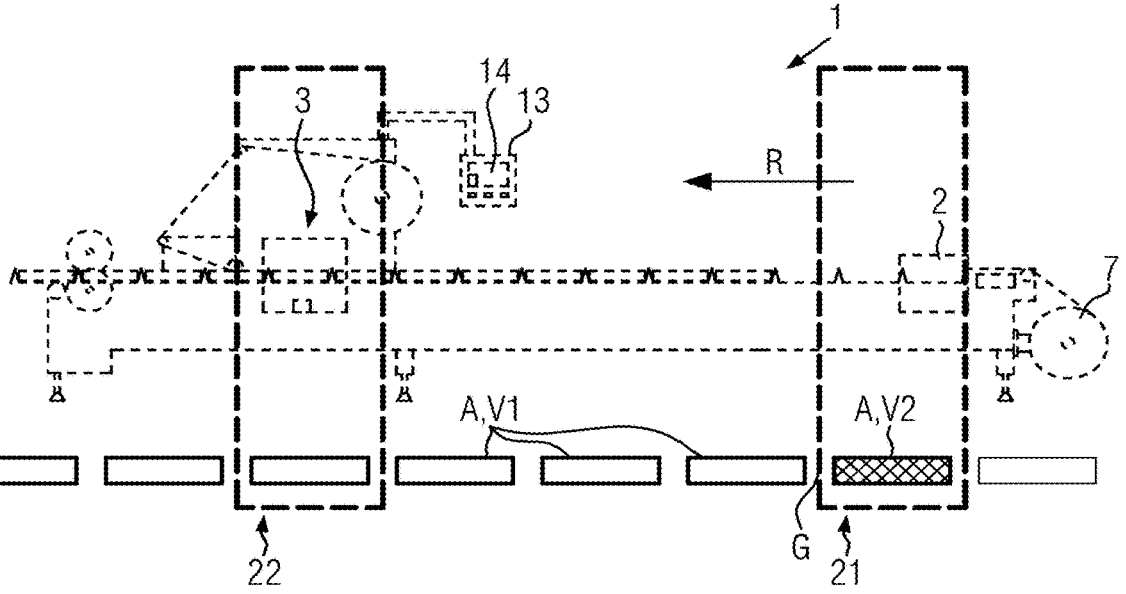

FIG. 4D shows that the retooling and/or adjustment process at the first workstation 21 is completed and the work cycle A that has been moved to the first workstation 21 is produced according to the second packaging recipe V2, i.e., the first workstation 21 operates for the first time according to the second packaging recipe V2. The work cycles A preceding this work cycle A in production direction R, on the other hand, continue to be produced according to the first packaging recipe V1.

Figure 4E:
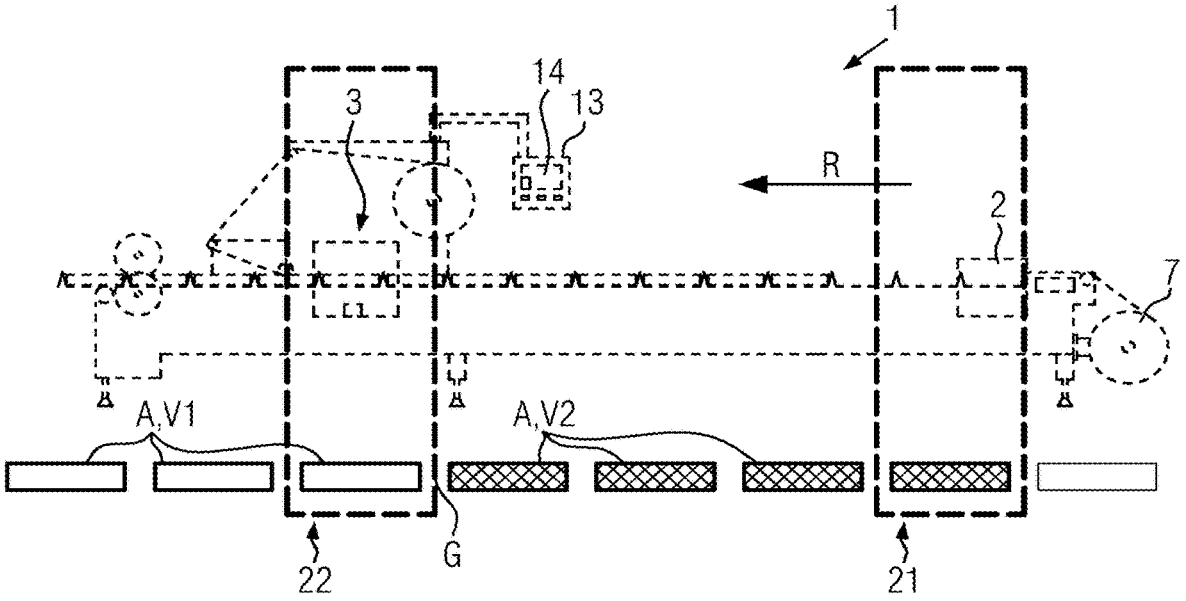

FIG. 4E shows that the change limit G has advanced to before the second work station 22, i.e., the work cycle A first produced according to the second packaging recipe V2 within the first work station 21 is immediately before the second work station 22 and, according to the subsequent main machine work cycle of the deep-drawing packaging machine 1, would follow next into the second work station 22. The preceding work cycles A were still produced according to the first packaging recipe V1.

Figure 4F:
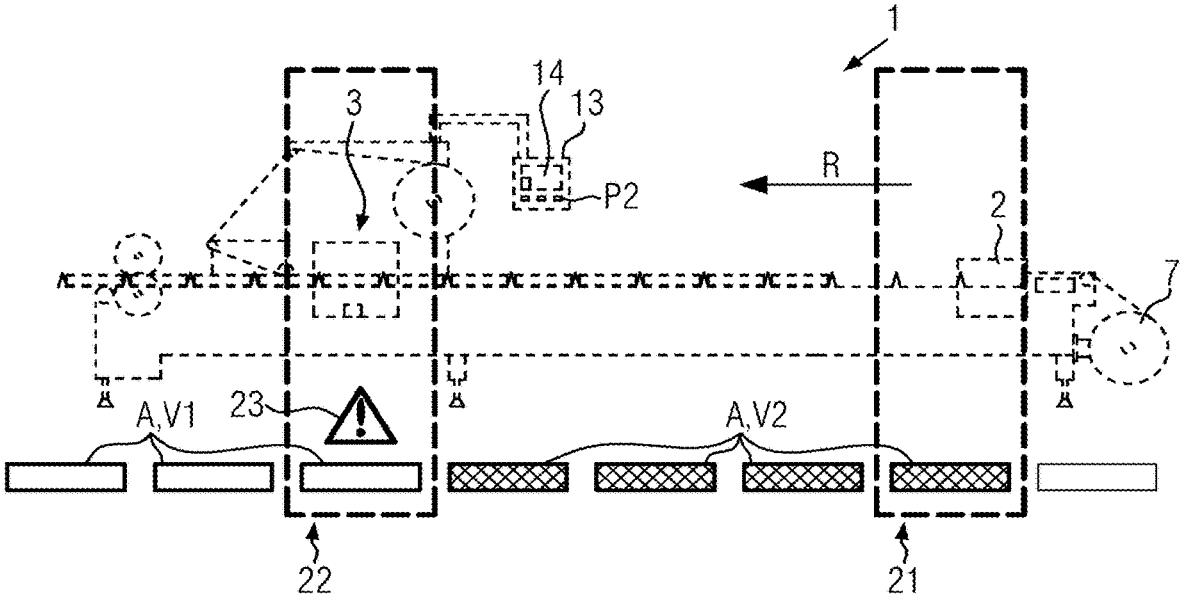

FIG. 4F shows that in response to the recipe change W previously activated on the deep-drawing packaging machine 1 in connection with FIG. 4B for the production of the work cycle A first formed in the production direction R within the second work station 22 in accordance with the second packaging format V2, at least one process parameter P2 required for this at the second work station 22 is automatically set and/or a retooling measure of the second work station 22 is indicated to the operator, wherein this occurs when the work cycle A directly preceding in production direction R the work cycle A first formed according to the second packaging recipe V2 and last formed according to the first packaging format V1 has advanced from the first work station 21 to the second work station 22, i.e., the change limit G is immediately before the second work station 22. This makes it possible to reset and/or retool the second work station 22 for producing the second packaging recipe V2 only after the work cycle A first formed according to the second packaging recipe V2 within the first work station 21 has moved up several main machine work cycles and finally arrived at the second work station 22. Intermediate work cycles A can accordingly be finished according to the first packaging recipe V1.

Figure 4G:
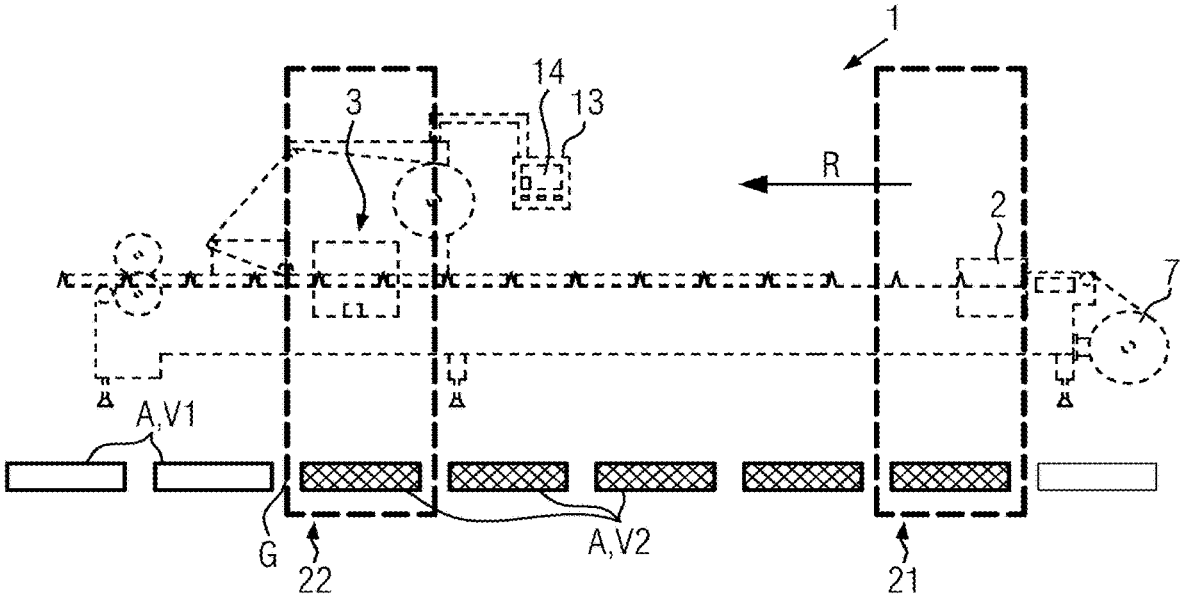

FIG. 4G shows that the second workstation 22 has been modified to the second packaging recipe V2 and is being produced for the first time within the second workstation 22 according to the second packaging recipe V2. The work cycles A preceding the first work cycle A, produced according to the second packaging recipe V2, continue to be divided according to the first packaging recipe V1 in the subsequent work stations, i.e., in the cross cutting device 4 and in the longitudinal cutting device 5.

In a comparable manner to the first and second work stations 21, 22 described above, the work stations following these, for example the transverse cutting device 4 and the longitudinal cutting device 5, may be adapted step by step, one after the other, for the production of the second packaging recipe V2.

Figure 4H:
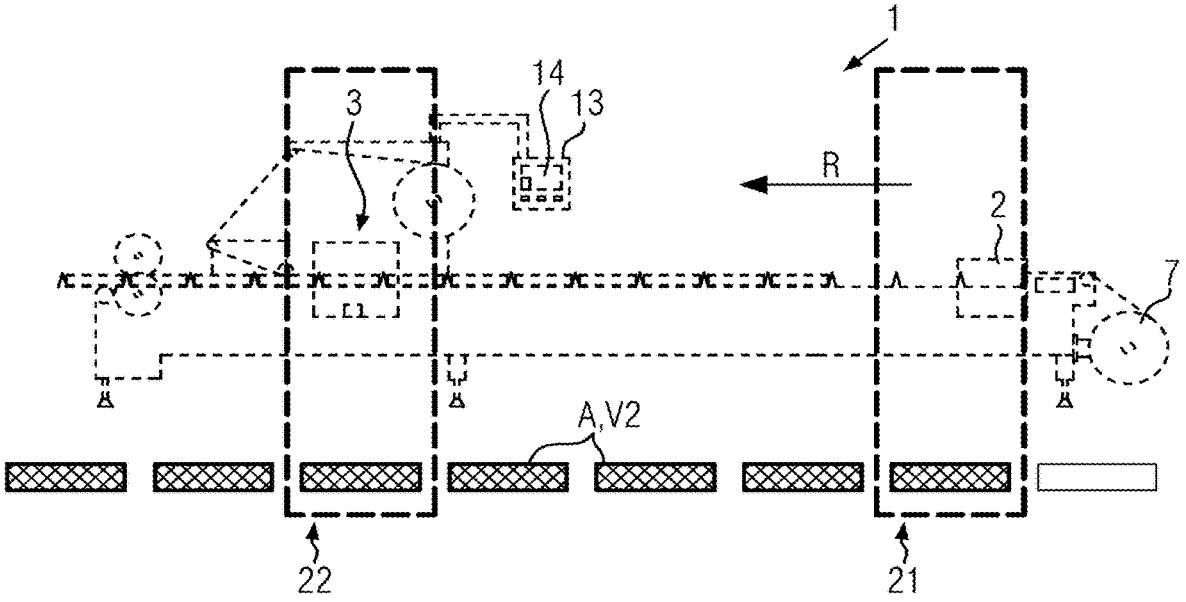

FIG. 4H shows that the deep-drawing packaging machine 1 is fully set and/or retooled for the production of the second packaging recipe V2. The representations of FIGS. 4A to 4H may be displayed as a route tracing by means of the display device 14 to the operator to enable him to track the progress of a change of the deep-drawing packaging machine 1 between the first packaging recipe V1 and the second packaging recipe V2. Above all, the route tracking may be used to display the advancement of the change limit G, so that the operator can see when he has to retool which workstation.

The recipe change W according to the disclosure may be used on various packaging machines or packaging lines, in particular on intermittently operating packaging machines or packaging lines.

As those skilled in the art will understand, the control device 13, as well as any other controller, station, component, module, system, subsystem, interface, sensor, device, or the like described herein may individually, collectively, or in any combination comprise appropriate circuitry, such as one or more appropriately programmed processors (e.g., one or more microprocessors including central processing units (CPU)) and associated memory, which may include stored operating system software, firmware, and/or application software executable by the processor(s) for controlling operation thereof and for performing the particular algorithm or algorithms represented by the various methods, functions and/or operations described herein, including interaction between and/or cooperation with each other. One or more of such processors, as well as other circuitry and/or hardware, may be included in a single Application-Specific Integrated Circuitry (ASIC) or Electronic Control Unit (ECU), or several processors and various circuitry and/or hardware may be distributed among several separate components, whether individually packaged or assembled into a System-on-a-Chip (SoC).

What is claimed is:

1. A device for a packaging process, wherein the device is provided in the form of a step-by-step packaging machine, or is configured as a step-by-step packaging line, the device comprising:

a first work station;

a second work station mounted at a distance from the first work station in a production direction; and a control device functionally connected to the first and second work stations, which is configured, based on a first control step, in response to a recipe change activated on the device from a first packaging recipe to a second packaging recipe for producing a work cycle formed first in the production direction within the first work station in accordance with the second packaging recipe to set automatically at least one process parameter required for producing the work cycle at the first workstation and/or to notify an operator of a retooling measure of the first work station, wherein the control device is further configured, in response to the activated recipe change by means of a second control step for producing the work cycle formed first in the production direction within the second work station in accordance with the second packaging recipe to automatically set at least one process parameter required for producing the work cycle at the second work station and/or to notify the operator of a retooling measure of the second work station, and wherein the control device is configured to perform the second control step after the first control step at a time when a work cycle directly preceding, in the production direction, the work cycle first formed according to the second packaging recipe and last formed according to the first packaging recipe within the first work station has advanced from the first work station into the second work station and has been only partially further processed in the second work station.

2. The device according to claim 1, wherein the control device is configured to carry out the first control step when the work cycle preceding directly in the production direction the work cycle to be produced first in accordance with the second packaging recipe and to be produced last in accordance with the first packaging recipe has advanced into the first work station or has been at least partially processed further therein.

3. The device according to claim 1, wherein the control device includes a display device by means of which, based on the first control step for the operator, at least one instruction for the retooling measure of the first work station and/or by means of which, based on the second control step for the operator, at least one instruction for the retooling measure of the second work station can be visualized.

4. The device according to claim 1, wherein the control device comprises a display device and the control device is configured to define, in response to the activated recipe change, a work cycle arriving at that moment within the first work station as a last work cycle to be produced according to the first packaging recipe and to follow intermittent advance of the work cycle along the device or to visualize the work cycle by means of the display device.

5. The device according to claim 1, wherein the recipe change for the device can be activated by means of the control device by an input made thereto for selection of a packaging recipe of a specific packaging type stored therein.

6. The device according to claim 1, wherein the device is provided with at least one pair of VR goggles for the operator, by means of which at least one instruction for the retooling measure of the first work station and/or the second work station can be visualized.

7. The device according to claim 1, wherein the first working station is configured as a forming station with a tool component for producing trays and the second working station is configured as a sealing station with a tool component for producing sealed trays.

8. The device according to claim 7, wherein the first control step applies to the tool component of the forming station and the second control step applies to the tool component of the sealing station.

9. The device according to claim 1, further comprising at least one transfer device which can be controlled by means of the control device for a step-by-step transport of the work cycles processed within the first work station to the second work station spaced apart from the first work station.

10. A method for carrying out a recipe change on an intermittently operating packaging machine or for carrying out a recipe change on an intermittently operating packaging line, the method comprising:

a control device setting, in response to a recipe change activated on the packaging machine or on the packaging line from a first packaging recipe to a second packaging recipe for producing a work cycle formed first in a production direction within a first work station in accordance with the second packaging recipe, based on a first control step, automatically at least one process parameter required for producing the work cycle at the first work station and/or notifying an operator of a retooling measure of the first work station; and the control device further setting, in response to the activated recipe change by means of a second control step for producing the work cycle formed first in a second work station, spaced apart from the first work station in the production direction, in accordance with the second packaging recipe, at least one process parameter required for producing the work cycle at the second work station and/or notifying the operator of a retooling measure of the second work station;

wherein the control device performs the second control step after the first control step at a time when a work cycle directly preceding, in the production direction, the work cycle first formed according to the second packaging recipe and last formed according to the first packaging recipe within the first work station has advanced from the first work station into the second work station, positioned spaced apart from the first work station in the production direction, and has been only partially further processed in the second work station.

11. The method according to claim 10, wherein the control device carries out the first control step when the work cycle preceding directly in the production direction the work cycle to be produced first in accordance with the second packaging recipe and to be produced last in accordance with the first packaging recipe has advanced into the first work station or has been at least partially processed further therein.

12. The method according to claim 10, wherein the control device includes a display device by means of which, based on the first control step for the operator, at least one instruction for the retooling measure of the first work station and/or by means of which, based on the second control step for the operator, at least one instruction for the retooling measure of the second work station is visualized.

13. A device for a packaging process, wherein the device is provided in the form of a step-by-step packaging machine, or is configured as a step-by-step packaging line, the device comprising:

a first work station;

a second work station mounted at a distance from the first work station in a production direction; and a control device functionally connected to the first and second work stations, which is configured, based on a first control step, in response to a recipe change activated on the device from a first packaging recipe to a second packaging recipe for producing a work cycle formed first in the production direction within the first work station in accordance with the second packaging recipe to set automatically at least one process parameter required for producing the work cycle at the first workstation and/or to notify an operator of a retooling measure of the first work station, wherein the control device is further configured, in response to the activated recipe change by means of a second control step for producing the work cycle formed first in the production direction within the second work station in accordance with the second packaging recipe to automatically set at least one process parameter required for producing the work cycle at the second work station and/or to notify the operator of a retooling measure of the second work station, and wherein the control device is configured to perform the second control step after the first control step at a time when a work cycle directly preceding, in the production direction, the work cycle first formed according to the second packaging recipe and last formed according to the first packaging recipe within the first work station has advanced from the first work station into the second work station and has been at least partially further processed in the second work station, wherein the control device comprises a display device and the control device is configured to define, in response to the activated recipe change, a work cycle arriving at that moment within the first work station as a last work cycle to be produced according to the first packaging recipe and to follow intermittent advance of the last work cycle along the device and to visualize the last work cycle by means of the display device.

* * * * *